US008918923B2

(12) United States Patent
Song

(10) Patent No.: US 8,918,923 B2
(45) Date of Patent: Dec. 30, 2014

(54) SWITCHING DEVICE FOR RIM WATER IN LOW TANK TOILET

(71) Applicant: Watos Corea Co., Ltd., Incheon-si (KR)

(72) Inventor: Tae Gwang Song, Seoul (KR)

(73) Assignee: Watos Corea Co., Ltd. (KR)

( * ) Notice: Subject to any disclaimer, the term of this patent is extended or adjusted under 35 U.S.C. 154(b) by 307 days.

(21) Appl. No.: 13/672,784

(22) Filed: Nov. 9, 2012

(65) Prior Publication Data

US 2013/0111658 A1 May 9, 2013

(30) Foreign Application Priority Data

Nov. 9, 2011 (KR) ..... 10-2011-0116451

(51) Int. Cl.

| | |
|---|---|
| ***E03D 1/00*** | (2006.01) |
| ***E03D 5/00*** | (2006.01) |
| ***E03D 1/32*** | (2006.01) |

(52) U.S. Cl.
CPC ... *E03D 5/00* (2013.01); *E03D 1/32* (2013.01)
USPC ..... 4/415

(58) Field of Classification Search
CPC ..... E03D 1/14
USPC ..... 4/300–442
See application file for complete search history.

(56) References Cited

FOREIGN PATENT DOCUMENTS

KR 100483510 4/2005

*Primary Examiner* — Lori Baker
(74) *Attorney, Agent, or Firm* — Cantor Colburn LLP

(57) ABSTRACT

A switching device for rim water in a low tank toilet, in which toilet water in a toilet tank is drawn and supplied to the rim of a toilet bowl by the pressure of water that is supplied from a filler valve to the rim through a water supply tube and a supply water switching unit is rotated according to a reduction in the water level of the toilet tank, so that the water supplied from the filler valve is charged into the toilet tank and, at the same time, some water supplied from the filler valve is supplied to the rim through a fill-up water inlet hole.

7 Claims, 17 Drawing Sheets

SWITCHING DEVICE FOR RIM WATER IN LOW TANK TOILET

BACKGROUND OF THE INVENTION

1. Field of the Invention

The present invention relates, in general, to a low tank toilet in which the height of a toilet tank is lower than that of the rim of a toilet bowl and, more particularly, to a switching device for rim water in a low tank toilet, in which toilet water in a toilet tank is drawn and supplied to a rim of a toilet bowl by the pressure of water that is supplied from a filler valve to the rim through a water supply tube and a supply water switching unit is rotated according to a reduction in the water level of the toilet tank, so that the water supplied from the filler valve is charged into the toilet tank and, at the same time, some water supplied from the filler valve is supplied to the rim through a fill-up water inlet hole.

2. Description of the Related Art

Generally, when a flush handle of a low tank toilet, in which a toilet tank is integrated with a toilet bowl into a single body and is filled with toilet water supplied from a filler valve, is manipulated to flush the toilet bowl after relieving oneself, a tank ball is opened by the flush handle and the toilet water is discharged from the toilet tank into the toilet bowl through a flush hole of the toilet tank. In the above state, some toilet water of the toilet tank is drawn and supplied to a rim of the toilet bowl by the pressure of cold water that is supplied from the filler valve to a water supply tube, so that the water is discharged to the toilet bowl through rim water discharge holes and washes the inner surface of the toilet bowl while removing urine and feces from the toilet bowl.

However, in the conventional low tank toilet, the rim is placed at a higher location than that of the toilet tank so that a sufficient amount of water cannot be supplied from the toilet tank to the rim and, accordingly, the water that is discharged from the rim cannot efficiently wash the inner surface of the toilet bowl.

In an effort to overcome the problems, a toilet having a rim water supply device using a jet pump has been proposed, as disclosed in Korean Patent No. 0483510.

As shown in FIGS. 1 and 2, the toilet disclosed in the above-mentioned patent is operated in such a way that, when a flush handle 16 is manipulated, a tank ball 15 is opened so that toilet water is discharged into a toilet bowl and, at the same time, cold water is supplied from a filler valve 13 through a filler valve connection tube 17. In the above state, a jet pump 20 is operated and the cold water is supplied into a rim water channel 18 together with the toilet water that has been stored in a toilet tank 12. Here, the toilet water in the toilet tank is drawn into the rim water channel 18 through an inlet port 24 by the pressure of the cold water. When the water level in the toilet tank 12 is reduced in the above state, a control ball 26 moves downward in a ball guide tube 25 and closes a throat 22.

Further, when the toilet water has been discharged from the toilet tank 12, the tank ball 15 is closed. In the above state, although cold water is continuously supplied from the filler valve 13, the control ball 26 closes the throat 22 so that the operation of the jet pump 20 is stopped and the cold water collides against the control ball 26, thereby being charged into the toilet tank 12. When the toilet tank is filled with cold water to a predetermined full water level, the filler valve 13 stops the supply of cold water and the control ball 26 moves upward in the ball guide tube 25 due to buoyancy and stays in a waiting state for next flushing.

However, the above-mentioned patent has the following problems. Although the toilet of the patent is provided with the jet pump at a location between the filler valve and the rim water channel so as to solve the problems experienced in the prior art and, accordingly, the amount of rim water that is supplied to the rim water channel can be increased, the toilet of the patent is problematic in that, when the toilet water is discharged in response to the operation of the flush handle and the water level in the toilet tank is thus reduced, the control ball very quickly drops to the inlet port due to a suction force that draws the toilet water in the toilet tank by the pressure of the cold water that is supplied from the filler valve, so that the control ball collides against the ball guide tube and generates noise.

In addition, the toilet water is continuously discharged from the toilet tank until the tank ball is closed and the control ball in the above state moves downward in the ball guide tube so that it is impossible to control the location at which the flow passage for water is switched. Further, the control ball closes the throat by the pressure of water that is supplied from the filler valve, so that it is impossible to supply fill-up water or to optionally control the control ball.

SUMMARY OF THE INVENTION

Accordingly, the present invention has been made keeping in mind the above problems occurring in the related art, and the present invention is intended to propose a switching device for rim water in a low tank toilet, in which a buoy pulls a supply water switching unit according to a reduction in the water level in a toilet tank in response to the discharge of toilet water and closes a water supply tube, thereby charging water from a filler valve into the toilet tank, and in which even when the water supply tube is closed, the water supplied from the filler valve can be supplied to a rim of a toilet bowl through a fill-up water inlet hole, thereby being discharged into the toilet bowl.

The present invention is also intended to propose a switching device for rim water in a low tank toilet, in which when flushing a toilet bowl using discharged water, in a normal state, water can be drawn both from a toilet tank and from a vertical pipe by the pressure of cold water that is supplied from a filler valve so that the toilet bowl can be efficiently washed using the water, and a water supply control unit moves downward according to a reduction in the water level of the toilet tank and discharges water from the vertical pipe, thereby causing a switching control unit to quickly move downward, and in an abnormal state in which the toilet bowl is blocked, a water supply control unit can retain the closed state of a discharge guide port, thereby allowing a user to safely use the low tank toilet.

In order to achieve the above object, according to one aspect of the present invention, there is provided a switching device for rim water in a low tank toilet, including: a water supply tube that guides water from a filler valve to a rim of a toilet bowl in response to operation of a flush handle; a supply water switching unit that is installed in an operating chamber formed through the water supply tube and that opens or closes a flow channel of the water supply tube in response to operation of a switching control unit, with a fill-up water inlet hole being formed through the supply water switching unit so that, when the flow channel is closed, some water supplied from the filler valve can be supplied to the rim; the switching control unit that pulls the supply water switching unit according to a reduction in a water level inside a vertical pipe thereof and closes the flow channel so that a toilet tank can be filled with water that is supplied from the filler valve; and a water supply control unit that is operated in such a way that, when the switching control unit pulls the supply water switching unit, in a normal state, a guide port on/off unit that is mounted to a discharge guide port moves downward and a float that is combined with the guide port on/off unit moves downward according to a reduction in a water level of the toilet tank so that the discharge guide port that is formed through a lower end of the vertical pipe can be opened and water is discharged from the vertical pipe through the open discharge guide port and, accordingly, the switching control unit can quickly move downward, however, when the toilet bowl is blocked and, accordingly, the water level is not reduced, the water supply control unit maintains a closed state of the discharge guide port.

The present invention is advantageous in that the buoy pulls the supply water switching unit and closes the water supply tube according to a reduction in the water level which is caused by the discharge of toilet water so that cold water that is supplied from the filler valve can be charged into the toilet tank, and, even when the water supply tube is closed, the water supplied from the filler valve can be supplied to the rim through the fill-up water inlet hole and can be discharged into the toilet bowl, so that the present invention can realize improved operation of the low tank toilet.

Another advantage of the present invention resides in that, when flushing the toilet bowl using discharged water, in a normal state, water can be drawn both from the toilet tank and from the vertical pipe by the pressure of cold water that is supplied from the filler valve so that the toilet bowl can be efficiently washed using the water, and the water supply control unit moves downward according to a reduction in the water level of the toilet tank and discharges water from the vertical pipe, thereby causing the switching control unit to quickly move downward, and in an abnormal state in which the toilet bowl is blocked, the water supply control unit can retain the closed state of the discharge guide port, thereby allowing a user to safely use the low tank toilet.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
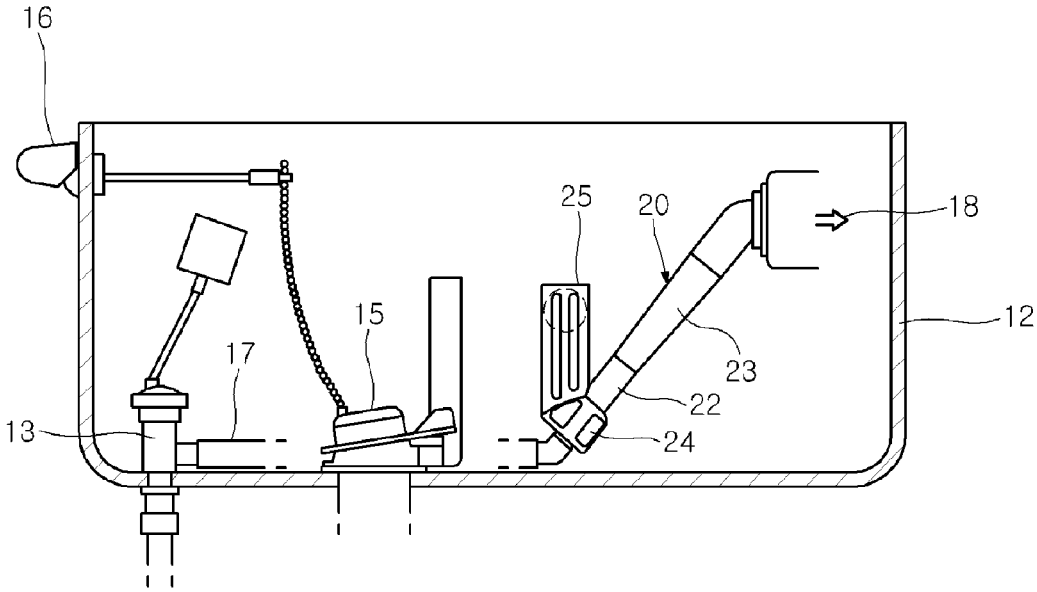
FIG. 1 is a sectional view of a conventional rim water supply device.
Figure 2:
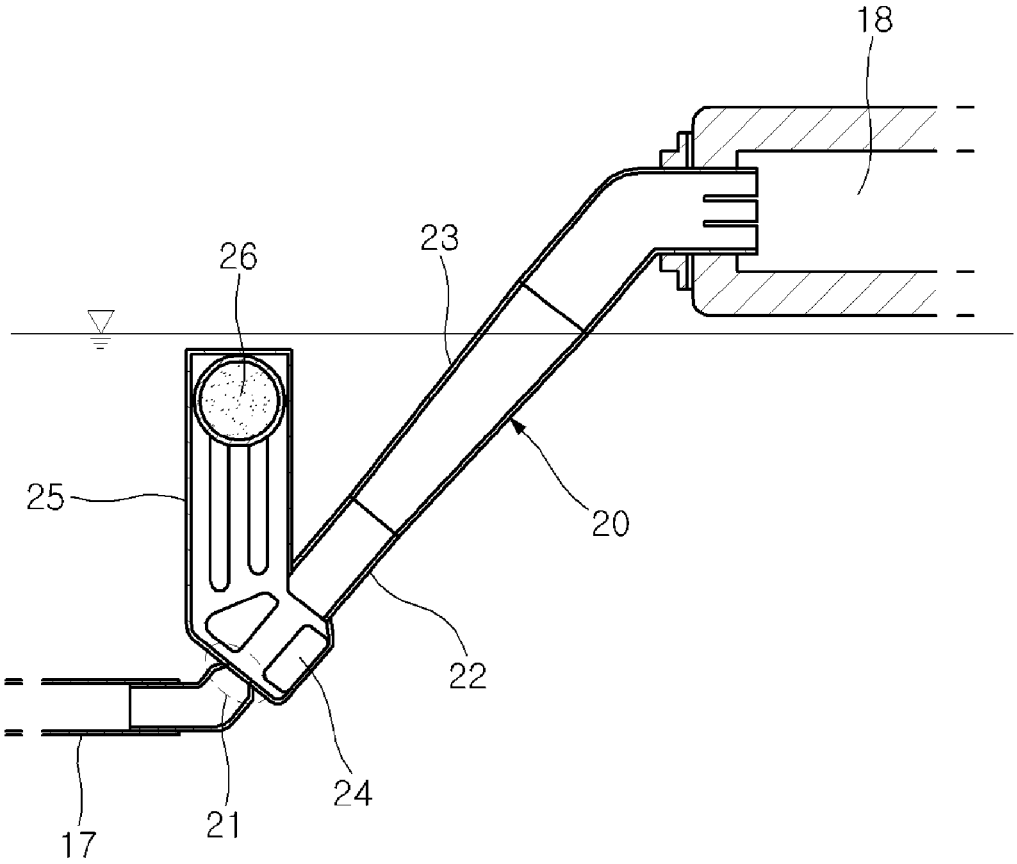
FIG. 2 is a sectional view illustrating the construction of a conventional jet pump.
Figure 3:
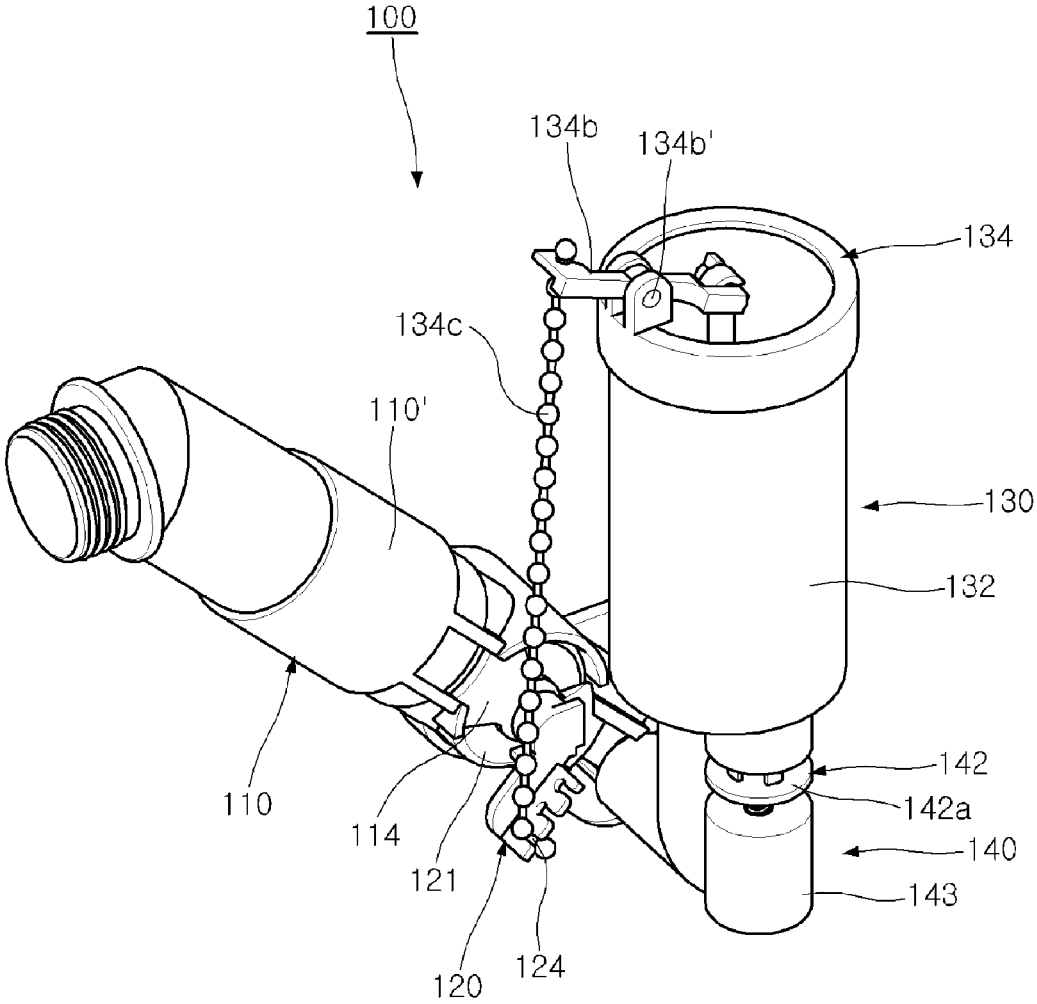
FIG. 3 is a perspective view of the present invention.

Hereinbelow, reference will now be made in greater detail to preferred embodiments of the invention with reference to the accompanying drawings. However, it should be understood that the present invention may be embodied in a plurality of forms without being limited to the embodiments described.

The switching device 100 for rim water in a low tank toilet of the present invention includes: a water supply tube 110 that guides water from a filler valve 13 to a rim 11*a* of a toilet bowl 11 in response to operation of a flush handle 16; a supply water switching unit 120 that is installed in an operating chamber 113 formed through the water supply tube 110 and that opens or closes a flow channel 111 of the water supply tube 110 in response to the operation of a switching control unit 130, with a fill-up water inlet hole 123 being formed through the supply water switching unit 120 so that, when the flow channel 111 is closed, some water supplied from the filler valve 13 can be supplied to the rim 11*a*; the switching control unit 130 that pulls the supply water switching unit 120 according to a reduction in the water level inside a vertical pipe 132 and closes the flow channel 111 so that a toilet tank 12 can be filled with water that is supplied from the filler valve 13; and a water supply control unit 140 that is operated in such a way that, when the switching control unit 130 pulls the supply water switching unit 120, a float 143 in a normal state moves downward according to a reduction in the water level of the toilet tank 12 so that a discharge guide port 141 can be opened and water is discharged from the vertical pipe 132 through the open discharge guide port 141 and, accordingly, the switching control unit 130 can quickly move downward, however, when the toilet bowl 11 is blocked and, accordingly, the water level is not reduced, the discharge guide port 141 can be maintained in a closed state. Hereinbelow, the present invention will be described in detail.

The water supply tube 110 includes the flow channel 111 that is defined through a pipe body 110' so as to guide water from the filler valve 13 to the rim 11*a*, an inlet opening 112 that is formed through the lower part of the pipe body 110' so as to communicate with the flow channel 111, the operating chamber 113 that is defined in the pipe body 110' at a position above the inlet opening 112 so as to receive the supply water switching unit 120 therein, and a cover 114 that holds the supply water switching unit 120 in the operating chamber 113.

The supply water switching unit 120 includes a switching unit body 121 that is rotatably installed in the operating chamber 113, a guide opening 122 that is formed in the switching unit body 121 so that it is open in a direction and guides water, the fill-up water inlet hole 123 that is formed through the switching unit body 121 so as to communicate with the guide opening 122 and supplies fill-up water to the toilet bowl 11, and at least one wire connection hole 124 that is provided on an end surface of the switching unit body 121 so that the wire connection hole 124 can be connected to the switching control unit 130 by a lift wire 134*c*.

The switching control unit 130 includes a discharge hole 131 that is formed through the lower part of the water supply tube 110, the vertical pipe 132 that is coupled to the discharge hole 131 and stores a predetermined amount of water therein, a buoy 133 that moves upward or downward according to a change in the water level inside the vertical pipe 132, and an actuating unit 134 that pulls and rotates the supply water switching unit 120 in response to downward movement of the buoy 133 and releases the pulling force from the supply water switching unit 120 in response to upward movement of the buoy 133.

The actuating unit 134 includes an actuating member 134*a* that is coupled to a center through hole 133' of the buoy 133 in such a way that the upper part of the actuating member 134*a* is projected outside the through hole 133', a rotating lever 134*b* that is coupled to the upper end of the actuating member 134*a* and is rotated around a hinge shaft 134*b*', and the lift wire 134*c* that connects the rotating lever 134*b* to the wire connection hole 124 of the supply water switching unit 120.

The water supply control unit 140 includes the discharge guide port 141 that is formed through the lower end of the vertical pipe 132, a guide port on/off unit 142 that is mounted to the discharge guide port 141 and opens or closes the discharge guide port 141 according to a change in the water level inside the toilet tank 12, and the float 143 that is combined with the guide port on/off unit 142 and generates buoyancy so as to close the discharge guide port 141.

The guide port on/off unit 142 includes an on/off plate 142*a* that opens or closes the discharge guide port 141, restraining pieces 142*b* that are provided on the upper surface of the on/off plate 142*a* and are fitted into the discharge guide port 141 so that the restraining pieces 142*b* are caught by the discharge guide port 141 and the guide port on/off unit 142 is prevented from being removed from the discharge guide port 141, and a float holder 142*c* that is formed on the lower surface of the on/off plate 142*a* and holds the float 143.

Here, to allow a user to control the height of the float 143 that is held by the float holder 142*c*, it is preferred that the float 143 be combined with the float holder 142*c* through a screw-type engagement.

Hereinbelow, the process of installing the switching device having the above-mentioned construction will be described in detail.

Figure 4:
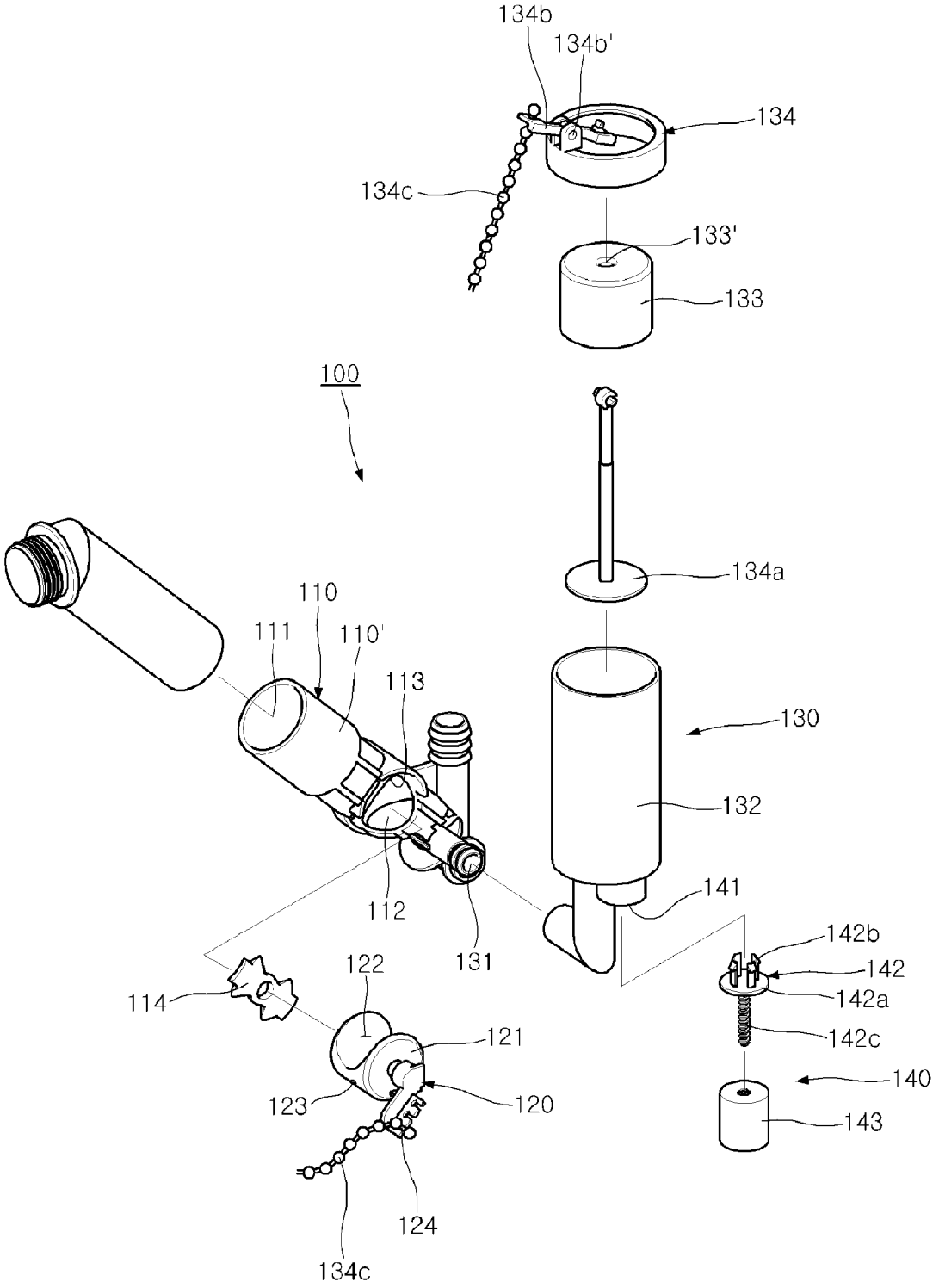
FIG. 4 is an exploded perspective view of the present invention.
Figure 5:
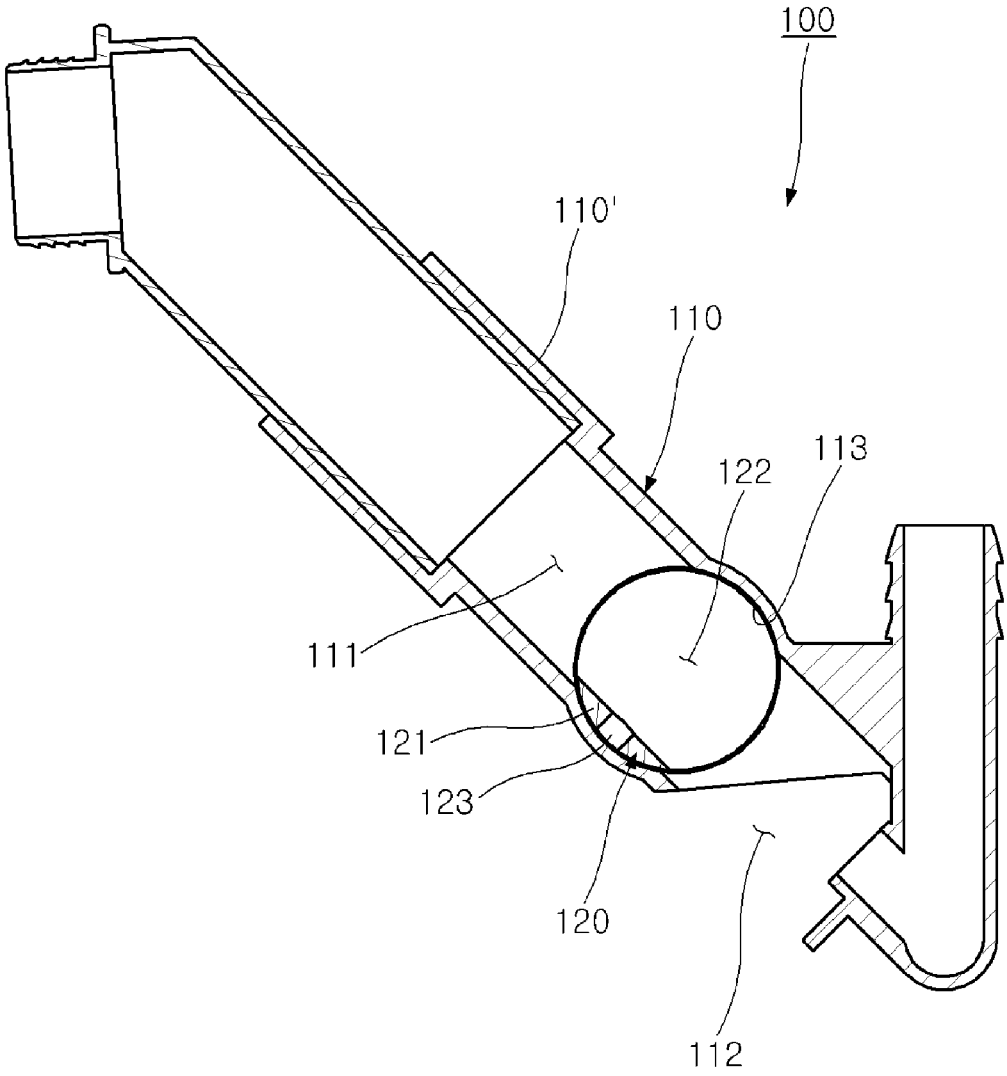
FIG. 5 is a side sectional view illustrating a water supply tube of the present invention.
Figure 6:
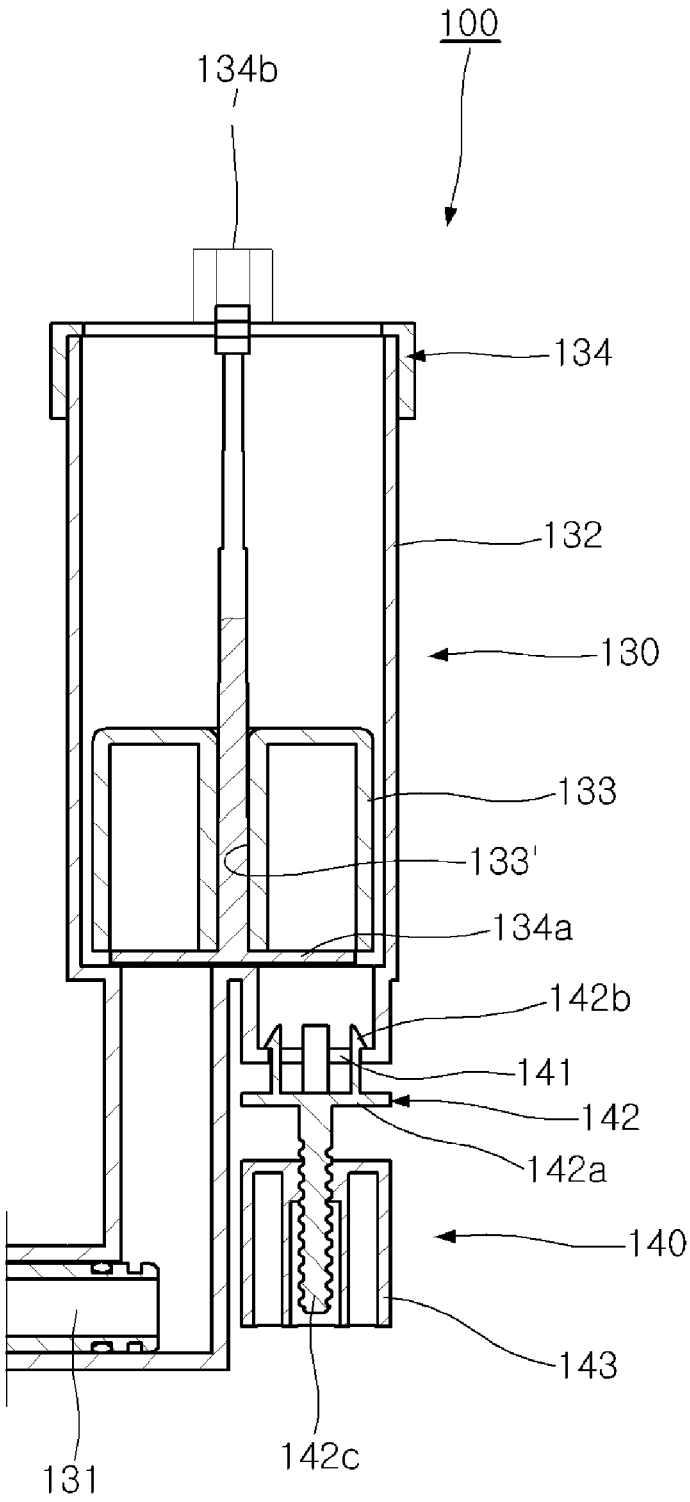
FIG. 6 is a front sectional view illustrating a switching control unit and a switching control unit of the present invention.
Figure 7:
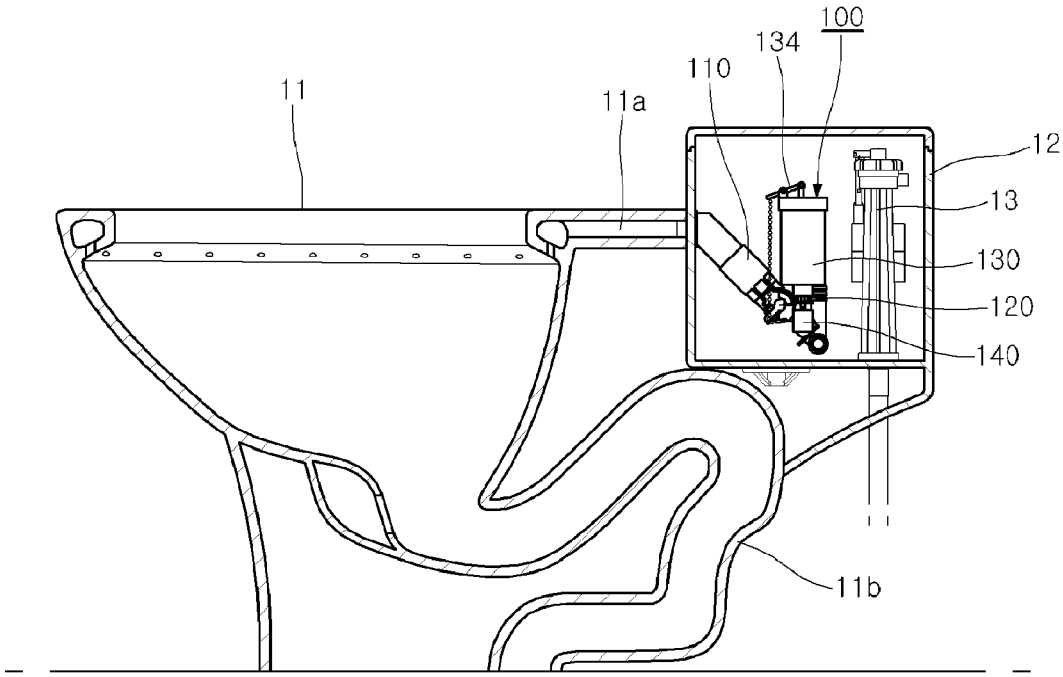
FIGS. 7 and 8 are views illustrating the present invention that is installed in a toilet.
Figure 8:
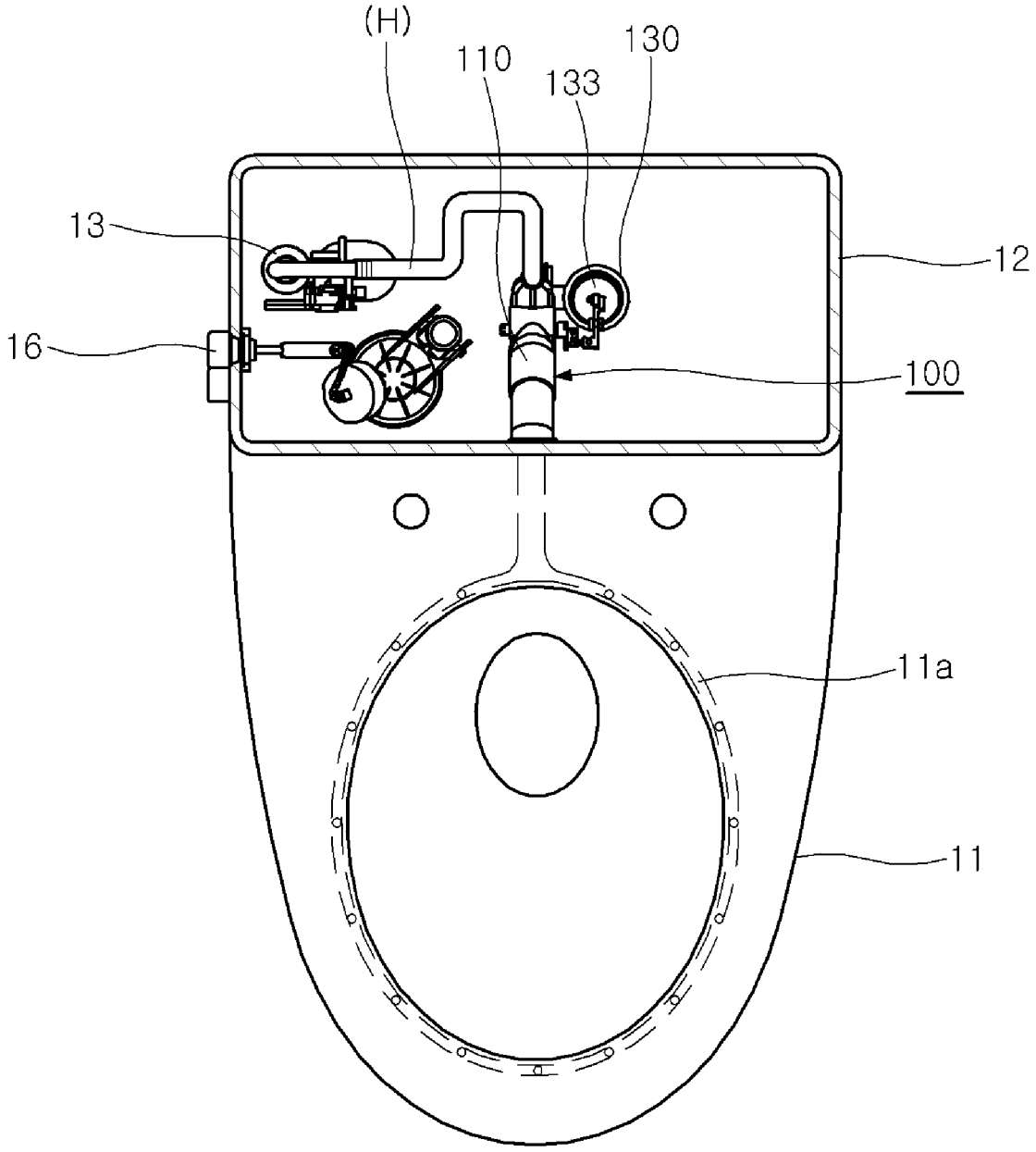

As shown in FIGS. 4 through 8, the supply water switching unit 120 is inserted into the operating chamber 113 of the water supply tube 110 from a side, thereby being installed in the operating chamber 113. Thereafter, the cover 114 is mounted to a side of the pipe body 110' so that the cover 114 can prevent the supply water switching unit 120 from being removed from the operating chamber 113.

Further, the lower part of the vertical pipe 132 of the switching control unit 130 is mounted to the discharge hole 131 that is provided on the water supply tube 110. The buoy 133 is combined with the actuating member 134*a* of the actuating unit 134 so that the buoy 133 can move upward or downward according to a change in the water level inside the vertical pipe 132.

Here, the upper end of the actuating member 134*a* that is combined with the buoy 133 is coupled to the rotating lever 134*b* that is rotatably held by the hinge shaft 134*b*', and an end of the rotating lever 134*b* is connected to the wire connection hole 124 of the supply water switching unit 120 by the lift wire 134*c*.

In addition, the restraining pieces 142*b* of the guide port on/off unit 142 are fitted under pressure into the lower end of the discharge guide port 141 that is formed through the lower end of the vertical pipe 132, and the float 143 is combined with the float holder 142*c*, which is formed on the lower surface of the on/off plate 142*a*, through a screw-type engagement.

The water supply tube 110 is connected to the filler valve 13 by a hose H so that the filler valve 13 can supply water to the water supply tube 110. Thereafter, the water supply tube 110 is connected to the rim 11*a* of the toilet bowl 11.

Hereinbelow, the operation of the switching device having the above-mentioned construction will be described in detail.

Figure 9:
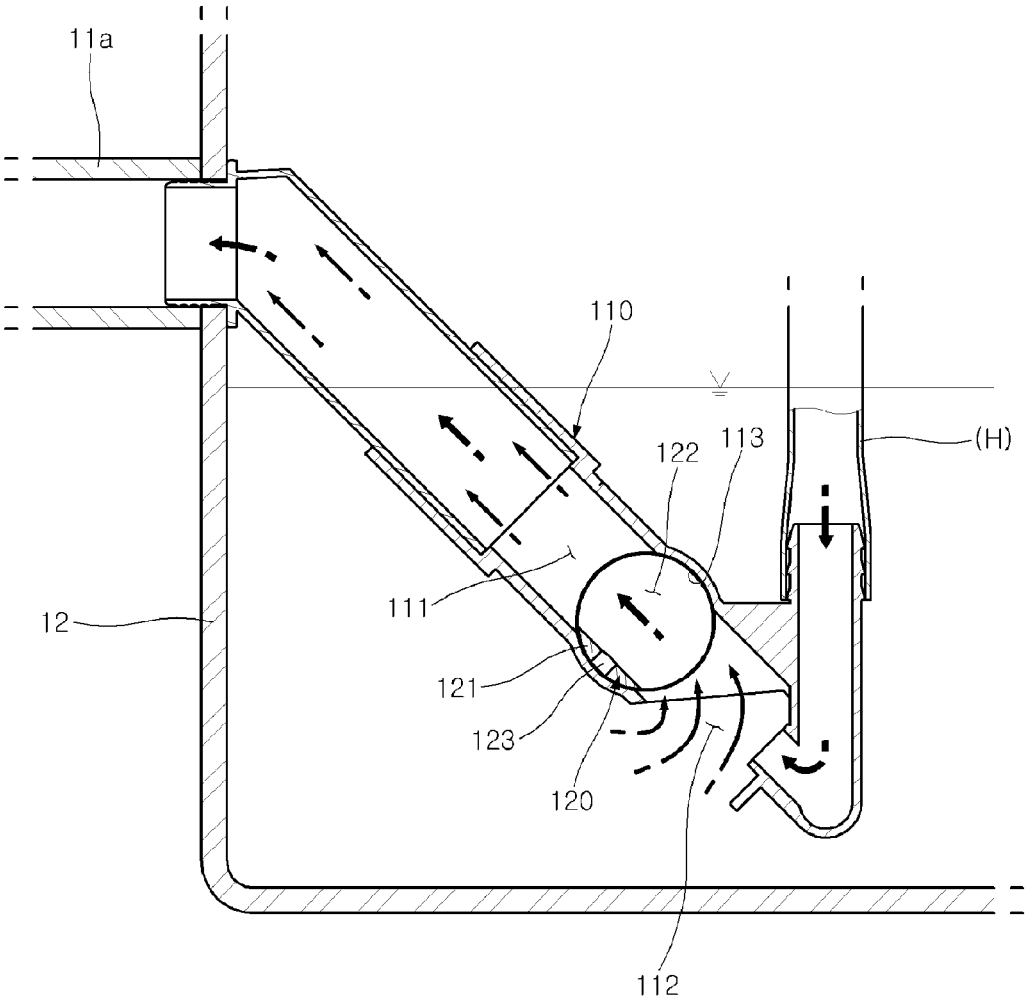
FIGS. 9 through 12 are views illustrating the operation of the present invention.
Figure 10:
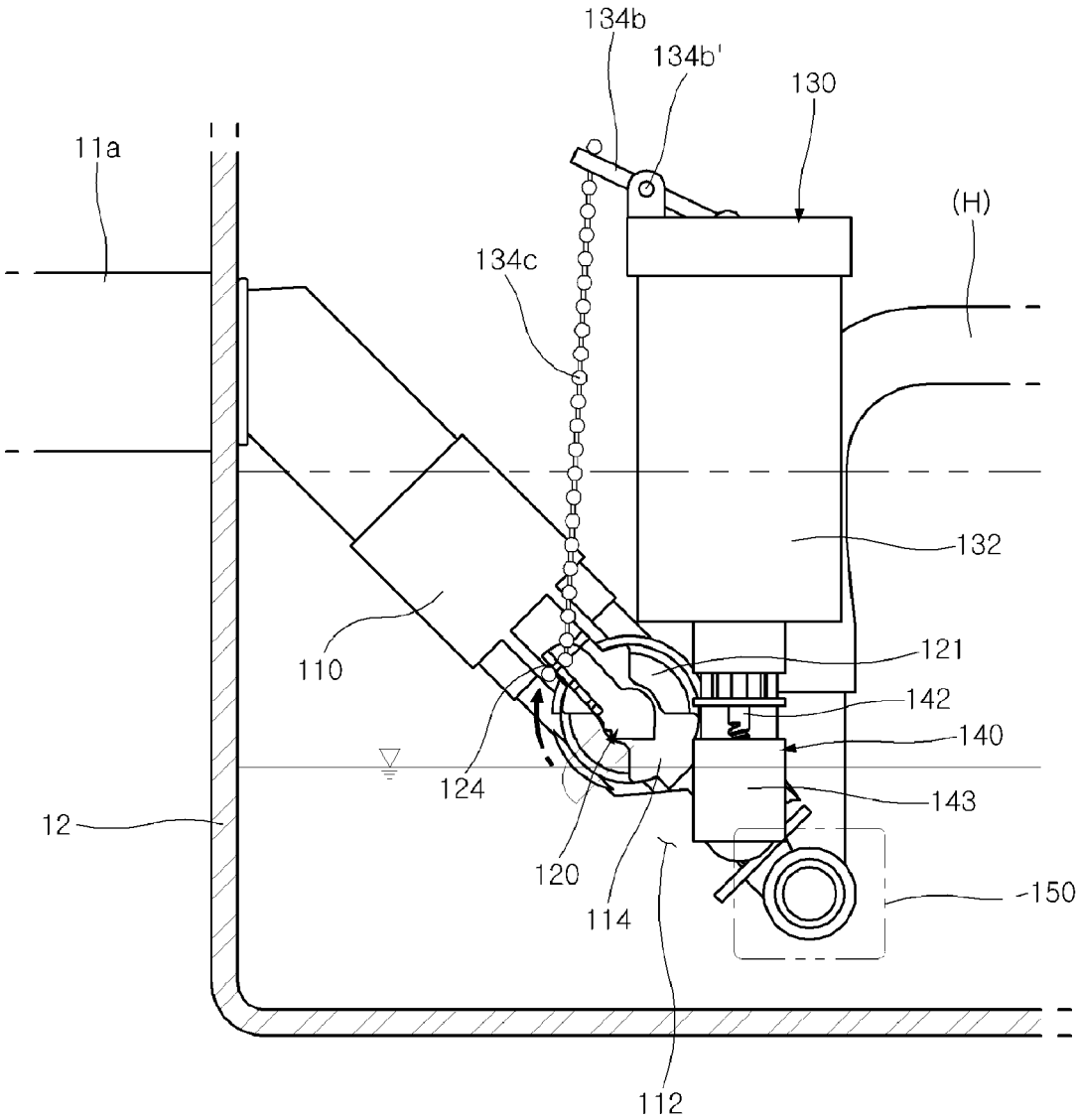
Figure 11:
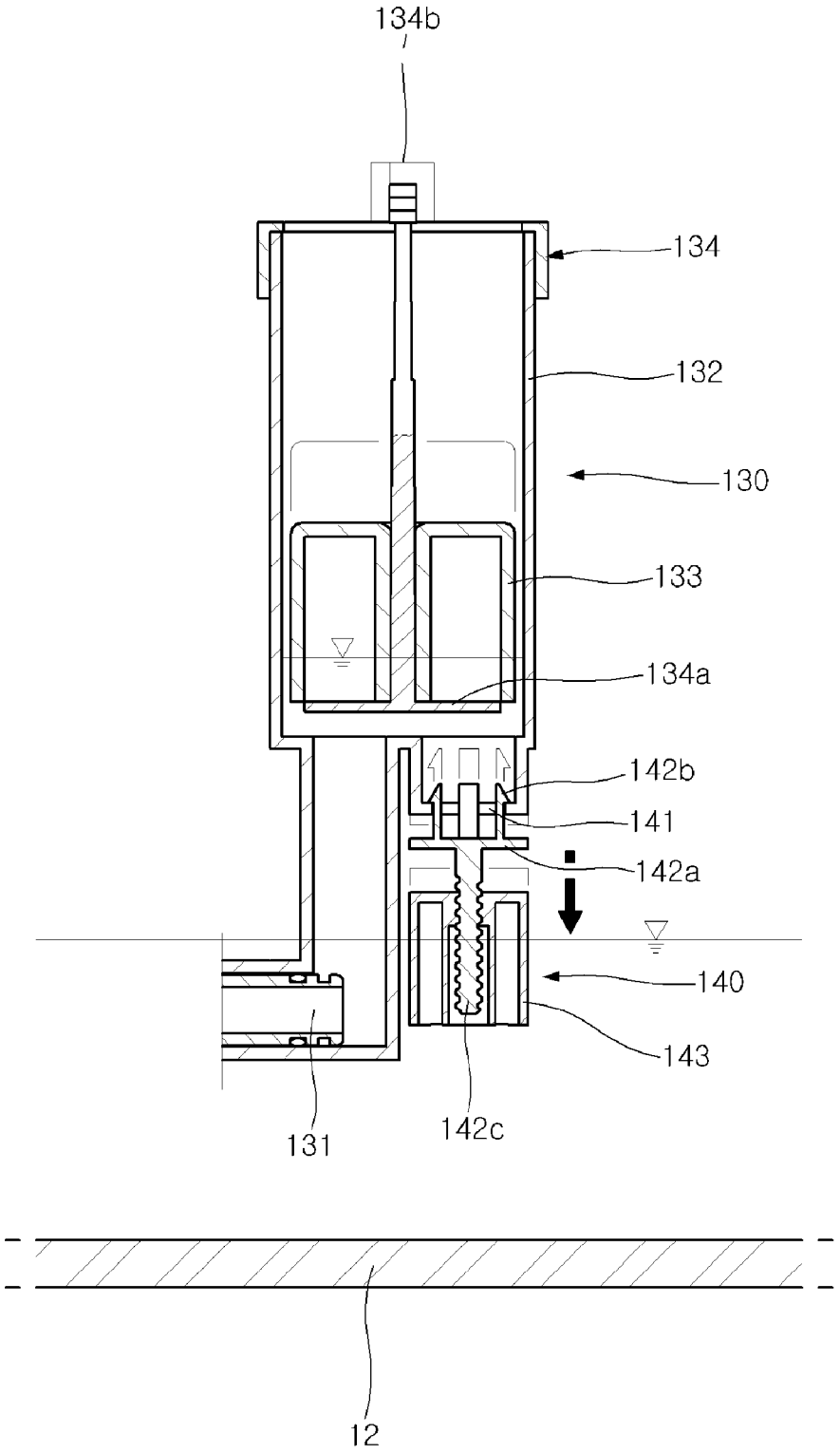
Figure 12:
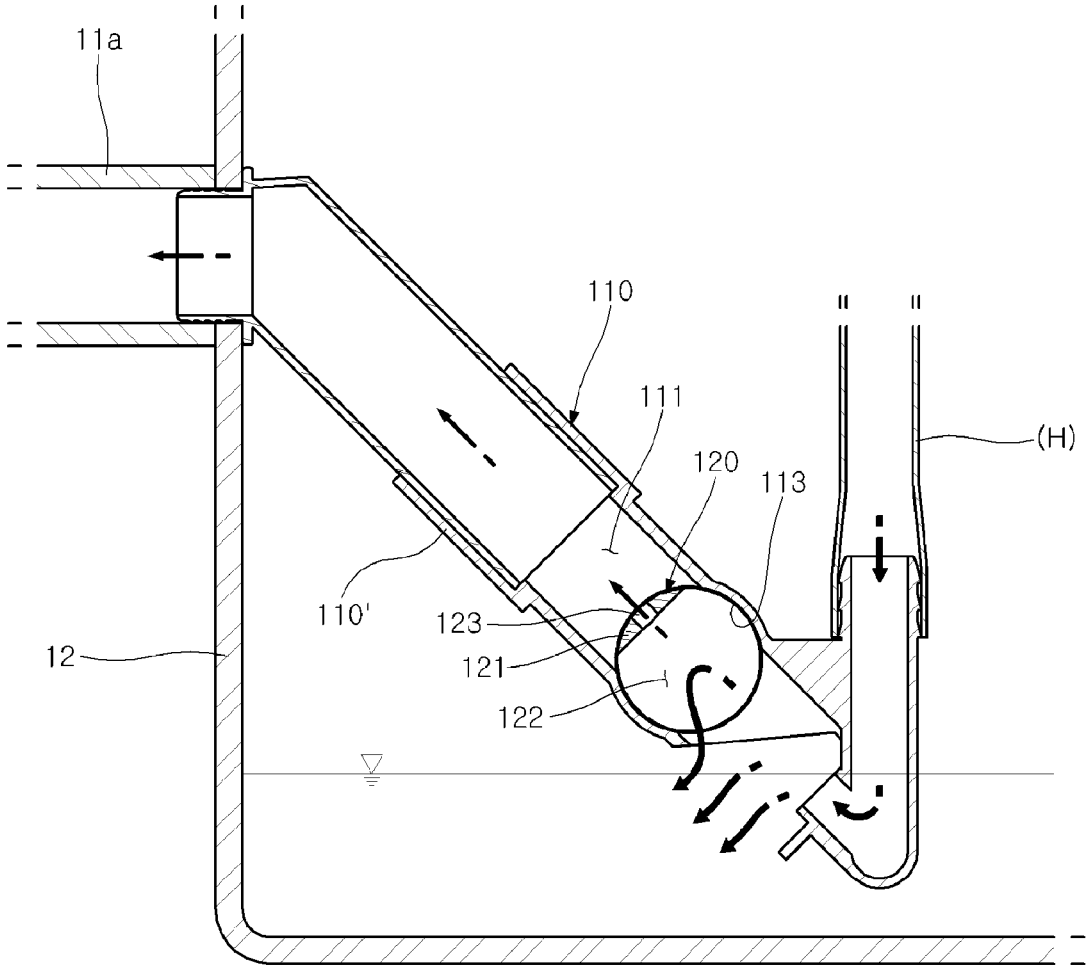

As shown in FIGS. 9 through 12, when the flush handle 16 is manipulated to flush the toilet bowl after relieving oneself, the tank ball 15 is opened and toilet water is discharged from the toilet tank 12 into the trap 11*b*.

When the toilet water is discharged into the trap 11*b* as described above, the filler valve 13 starts the supply of cold water to the toilet tank 12. In the above state, the cold water from the filler valve 13 is supplied to the water supply tube 110 through the hose H that is connected to the filler valve 13.

In the water supply tube 110, water is supplied both to the guide opening 122 of the supply water switching unit 120 and to the flow channel 111 of the pipe body 110'. In the above state, toilet water that is stored in the toilet tank 12 is drawn into the inlet opening 112 by the pressure of water that is supplied from the filler valve 13, so that the toilet water can be supplied to the rim 11*b* through the flow channel 111.

Further, water that is stored in the vertical pipe 132 of the switching control unit 130 is discharged into the flow channel 111 through the discharge hole 131 of the water supply tube 110 so that the water level in the toilet tank 12 is reduced.

Here, the water that is stored in the toilet tank 12 is more quickly discharged to the rim 11*a* than the water that is stored in the vertical pipe 132, so that the water level in the toilet tank 12 becomes lower than the water level in the vertical pipe 132. Accordingly, the float 143 of the water supply control unit 140 moves downward according to the reduction in the water level so that the on/off plate 142*c* of the guide port on/off unit 142 opens the discharge guide port 141 of the vertical pipe 132, thereby discharging water from the vertical pipe 132 into the toilet tank 12 through the discharge guide port 141.

When the water is discharged from the vertical pipe 132 into the toilet tank 12 through the discharge guide port 141 as described above, the buoy 133 of the switching control unit 130 quickly moves downward in the vertical pipe 132 and, at the same time, the actuating member 134*a* that is combined with the buoy 133 moves downward.

Due to the downward movement of the buoy 133, the rotating lever 134*b* is rotated around the hinge shaft 134*b*'. This rotation of the rotating lever 134*b* lifts the supply water switching unit 120 by the lift wire 134*c* so that the flow channel 111 of the water supply tube 110 is closed.

When the flow channel 111 is closed as described above, water that is supplied from the filler valve 13 is charged into the toilet tank 12 and some water in the toilet tank 12 is supplied to the rim 11*a* through the fill-up water inlet hole 123, thereby washing the toilet bowl 11.

When the water level in the toilet tank 12 is increased by water supplied from the filler valve 13 after flushing the toilet bowl, a predetermined amount of water is stored in the vertical pipe 132 of the switching control unit 130 and, at the same time, both the buoy 133 and the actuating member 134*a* move upward in the vertical pipe 132. Due to the upward movement of the buoy 133, the rotating lever 134*b* is rotated around the hinge shaft 134*b*' and releases the pulling force that had acted on the supply water switching unit 120.

In the above state, the supply water switching unit 120 from which the pulling force is released is rotated by the weight of the switching unit body 121 having the guide opening 122 so that the flow channel 111 of the water supply tube 110 can be opened.

Further, the float 143 of the water supply control unit 140 that is mounted to the vertical pipe 132 moves upward according to the increase in the water level of the toilet tank 12 so that the guide port on/off unit 142 closes the discharge guide port 141.

Figure 13:
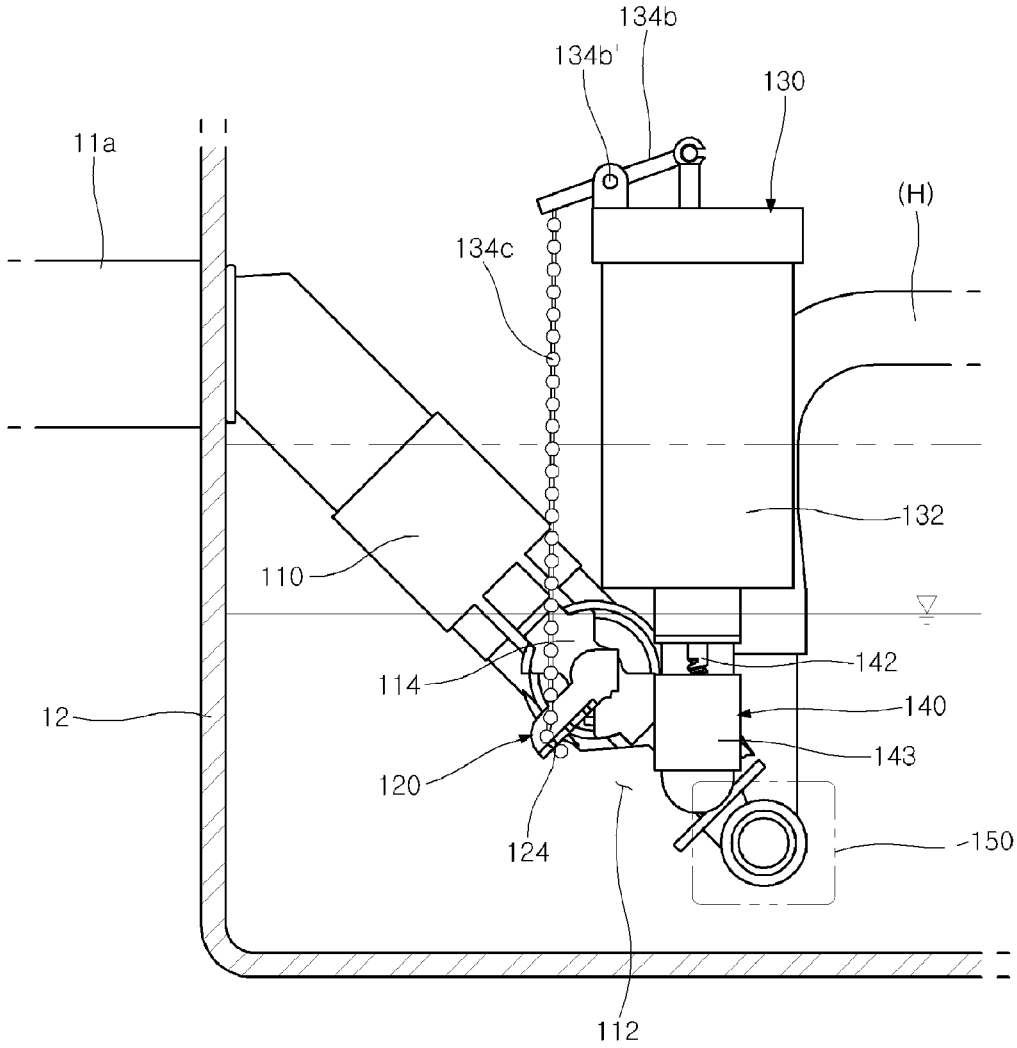
FIGS. 13 through FIG. 17 are views illustrating the operation of the present invention when a toilet bowl is blocked during a process of flushing the toilet bowl.
Figure 14:
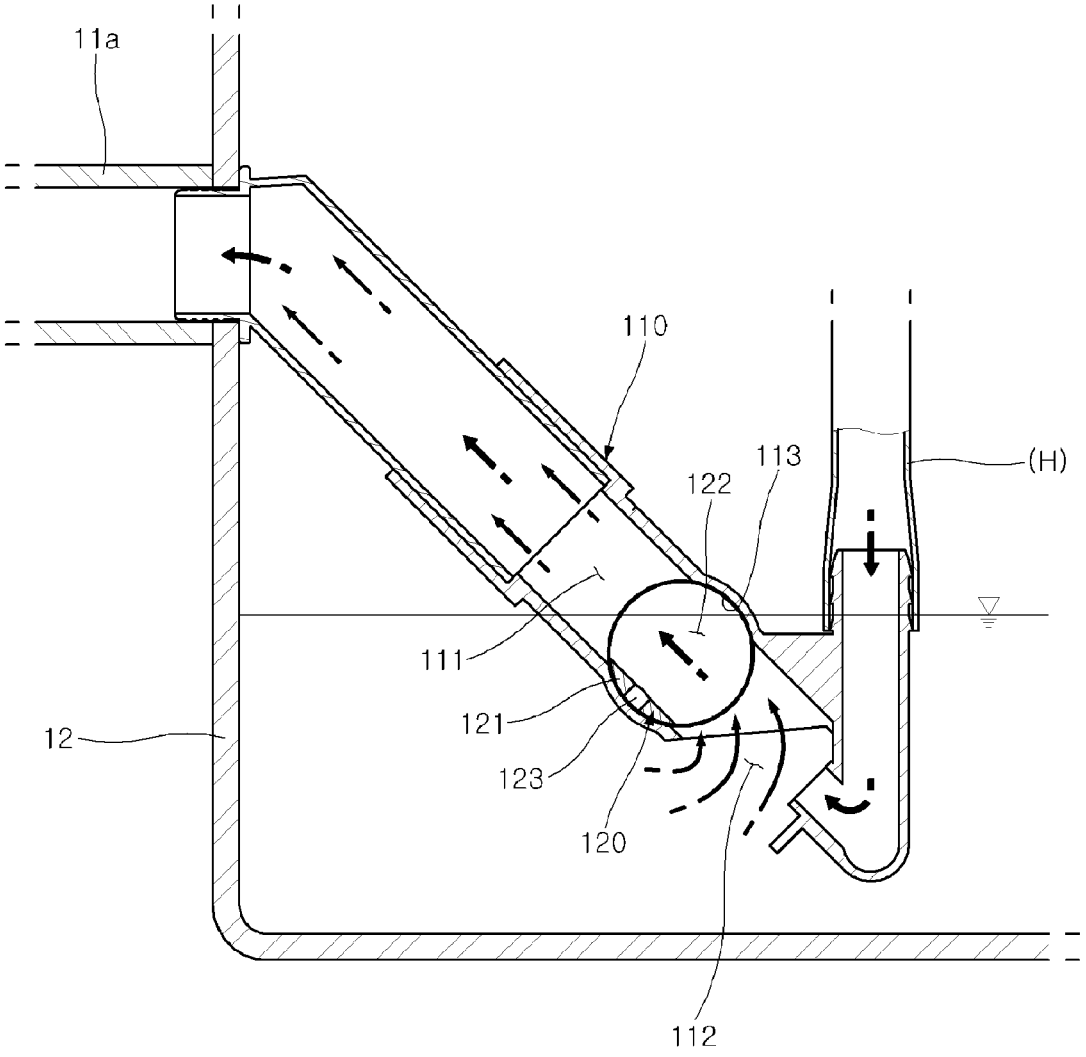
Figure 15:
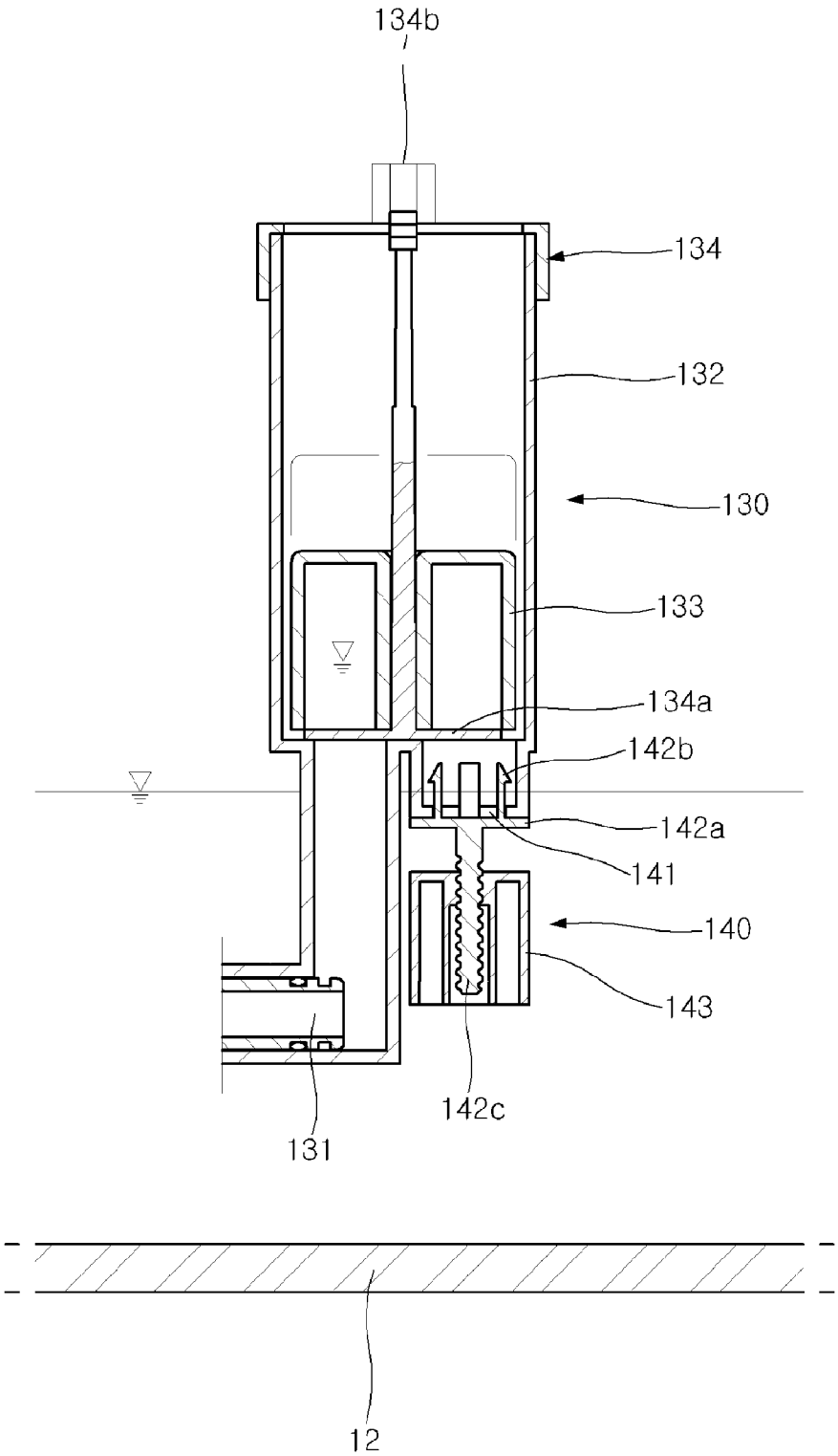
Figure 16:
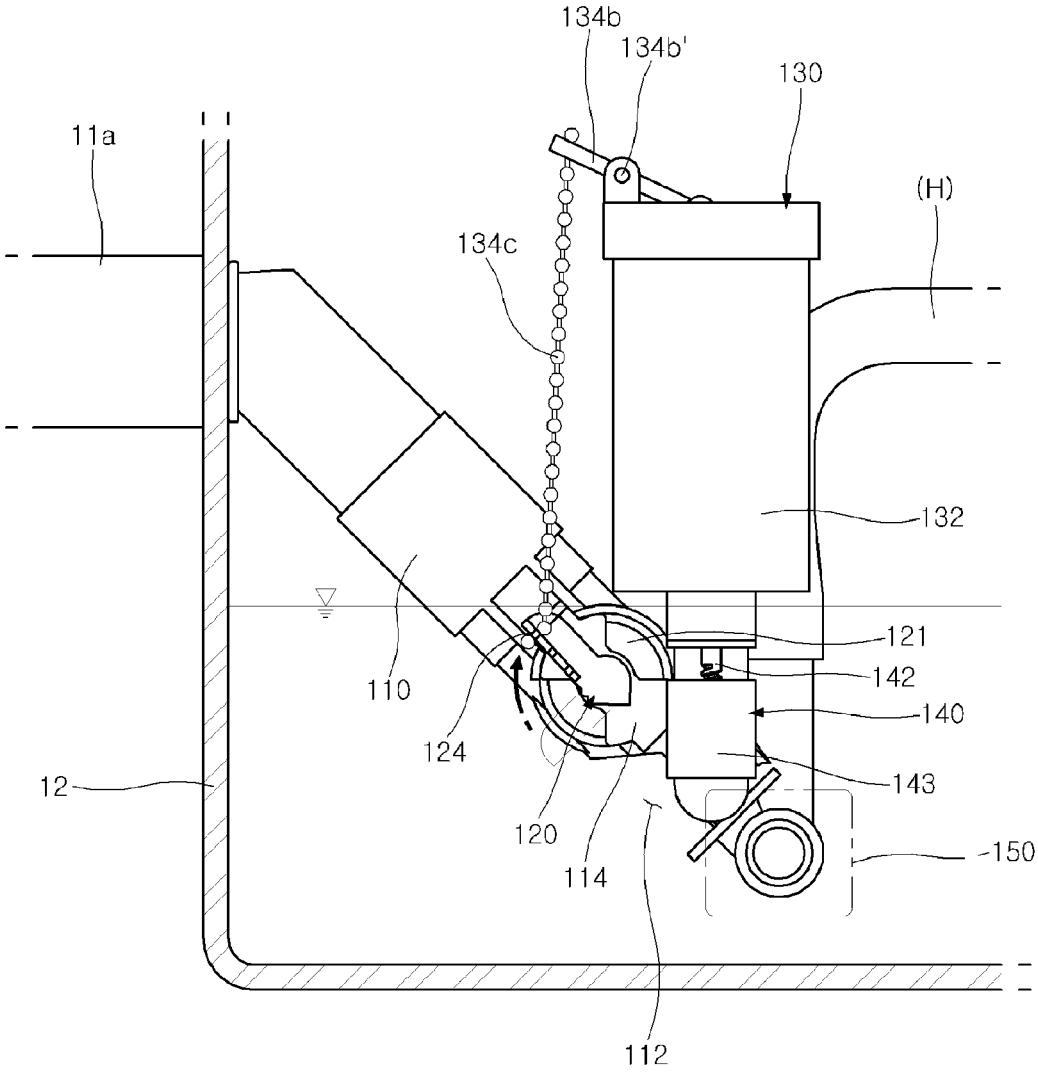
Figure 17:
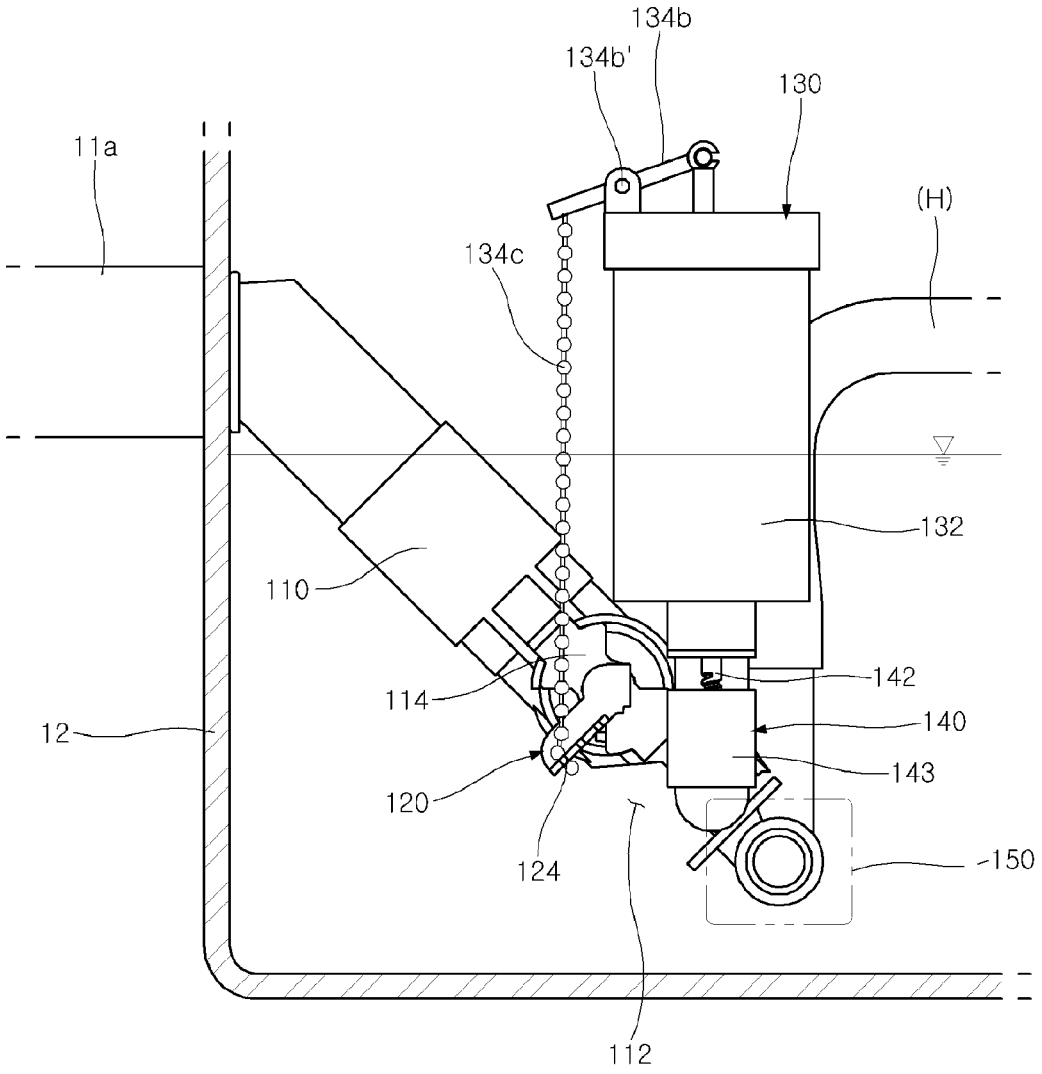

In addition, as shown in FIGS. 13 through 17, when the toilet bowl 11 is blocked or is not normally operated because of refuse in a state in which toilet water is discharged from the toilet tank 12 into the toilet bowl 11 so as to flush the bowl 11, the water level in the toilet tank 12 is not reduced from a predetermined level.

In the above state, the cold water that is supplied from the filler valve 13 is discharged to the rim 11*a* through the water supply tube 110 and, at the same time, the toilet water stored in the toilet tank 12 is drawn into the water supply tube 110 by the pressure of the cold water and is discharged to the rim 11*a*. Further, the water stored in the vertical pipe 132 is drawn into the discharge hole 131 by the pressure of the cold water and is discharged to the rim 11*a*.

In a state in which water is stored in the toilet tank 12, water that is stored in the vertical pipe 132 is discharged through the water supply tube 110, so that the water level in the vertical pipe 132 is more quickly reduced than the water level in the toilet tank 12 and the buoy 133 quickly moves downward. Here, the water level in the toilet tank 12 is higher than the water level that gives buoyancy to the water supply control unit 140 which is mounted to the vertical pipe 132, so that the water supply control unit 140 retains the closed state of the discharge guide port 141 of the vertical pipe 132.

Accordingly, the water that is stored in the vertical pipe 132 is discharged to the interior of the toilet tank 12 through the discharge guide port 141 and, at the same time, the buoy 133 moves downward to the lower part of the vertical pipe 132 so that the rotating lever 134*b* is rotated. This rotation of the rotating lever 134*b* lifts the supply water switching unit 120 by the lift wire 134*c* and closes the flow channel 111.

In the state in which the flow channel 111 is closed as described above, water is charged into the toilet tank 12. Due to an increase in the level of water that is stored in the toilet tank 12, the buoy 133 and the actuating member 134*a* of the switching control unit 130 move upward. When the toilet tank 12 is filled with water to a predetermined full water level, the filler valve 13 stops the supply of cold water and the rotating lever 134*b* releases the pulling force from the lift wire 134*c* and stays in a waiting state for next flushing.

Further, the water supply tube 110 may be provided with a supply water amount control unit 150 so as to control the amount of water that is supplied from the filler valve 13 to the water supply tube 110.

Although the present invention has been described for illustrative purposes with embodiments and accompanying drawings, the terminologies or words used in the description and the claims of the present invention should not be interpreted as being limited merely to their common and dictionary meanings. On the contrary, they should be interpreted based on the meanings and concepts of the invention in keeping with the scope of the invention. Accordingly, it is to be understood that the form of the present invention shown and described in the embodiments and in the accompanying drawings is to be taken as preferred embodiments of the present invention and that various changes and modifications may be made in the invention without departing from the scope and spirit of the invention as disclosed in the accompanying claims.

What is claimed is:

1. A switching device for rim water in a low tank toilet, comprising:

a water supply tube that guides water from a filler valve to a rim of a toilet bowl in response to operation of a flush handle;

a supply water switching unit that is installed in an operating chamber formed through the water supply tube and that opens or closes a flow channel of the water supply tube in response to operation of a switching control unit, with a fill-up water inlet hole being formed through the supply water switching unit so that, when the flow channel is closed, some water supplied from the filler valve can be supplied to the rim;

the switching control unit that pulls the supply water switching unit according to a reduction in a water level inside a vertical pipe thereof and closes the flow channel so that a toilet tank can be filled with water that is supplied from the filler valve; and a water supply control unit that is operated in such a way that, when the switching control unit pulls the supply water switching unit, in a normal state, a guide port on/off unit that is mounted to a discharge guide port moves downward and a float that is combined with the guide port on/off unit moves downward according to a reduction in a water level of the toilet tank so that the discharge guide port that is formed through a lower end of the vertical pipe can be opened and water is discharged from the vertical pipe through the open discharge guide port and, accordingly, the switching control unit can quickly move downward, however, when the toilet bowl is blocked and, accordingly, the water level is not reduced, the water supply control unit maintains a closed state of the discharge guide port.

2. The switching device for rim water in the low tank toilet as set forth in claim 1, wherein the water supply tube includes:

the flow channel that is defined through a pipe body of the water supply tube so as to guide water from the filler valve to the rim;

an inlet opening that is formed through a lower part of the pipe body of the water supply tube so as to communicate with the flow channel;

the operating chamber that is defined in the pipe body of the water supply tube at a position above the inlet opening so as to receive the supply water switching unit therein; and a cover that holds the supply water switching unit in the operating chamber.

3. The switching device for rim water in the low tank toilet as set forth in claim 1, wherein the supply water switching unit includes:

a switching unit body that is rotatably installed in the operating chamber;

a guide opening that is formed in the switching unit body so that the guide opening is open in a direction and guides water;

the fill-up water inlet hole that is formed through the switching unit body so as to communicate with the guide opening and supplies fill-up water to the toilet bowl; and at least one wire connection hole that is provided on an end surface of the switching unit body so that the wire connection hole can be connected to the switching control unit by a lift wire.

4. The switching device for rim water in the low tank toilet as set forth in claim 1, wherein the switching control unit includes:

a discharge hole that is formed through a lower part of the water supply tube;

the vertical pipe that is coupled to the discharge hole and stores a predetermined amount of water therein;

a buoy that moves upward or downward according to a change in the water level inside the vertical pipe; and an actuating unit that pulls and rotates the supply water switching unit in response to downward movement of the buoy and releases a pulling force from the supply water switching unit in response to upward movement of the buoy.

5. The switching device for rim water in the low tank toilet as set forth in claim 4, wherein the actuating unit includes:

an actuating member that is combined with a through hole of the buoy in such a way that an upper part of the actuating member is projected outside the through hole;

a rotating lever that is coupled to an upper end of the actuating member and is rotated around a hinge shaft; and a lift wire that connects the rotating lever to a wire connection hole of the supply water switching unit.

6. The switching device for rim water in the low tank toilet as set forth in claim 1, wherein the guide port on/off unit includes:

an on/off plate that opens or closes the discharge guide port;

a restraining piece that is provided on an upper surface of the on/off plate and is caught by the discharge guide port so as to prevent the guide port on/off unit from being removed from the discharge guide port; and a float holder that is formed on a lower surface of the on/off plate and holds the float.

7. The switching device for rim water in the low tank toilet as set forth in claim 6, wherein the float is combined with the float holder through a screw-type engagement so that a height of the float that is held by the float holder can be controlled.

* * * * *